United States Patent [19]

Troiano

[11] 4,321,708

[45] Mar. 30, 1982

[54] GOLF HAT WITH BLINDERS

[76] Inventor: Joseph Troiano, 80 Mahan St., West Babylon, N.Y. 11704

[21] Appl. No.: 221,035

[22] Filed: Dec. 29, 1980

[51] Int. Cl.[3] ..... A42B 1/18

[52] U.S. Cl. ..... 2/10; 2/199

[58] Field of Search ..... 2/10, 12, 15, 172, 449, 2/451, 199

[56] References Cited

U.S. PATENT DOCUMENTS

| | | | |
|---|---|---|---|
| 1,807,475 | 5/1931 | Gibson | 2/15 |
| 2,717,386 | 9/1955 | Linster | 2/12 |

FOREIGN PATENT DOCUMENTS

| | | | |
|---|---|---|---|
| 108478 | 1/1925 | Switzerland | 2/10 |
| 14855 | 9/1916 | United Kingdom | 2/10 |
| 819410 | 9/1959 | United Kingdom | 2/10 |

OTHER PUBLICATIONS

Gershman, "Self-Adhering Nylon Tapes", 10-18-58, J.A.M.A., p. 930.

*Primary Examiner*—Peter P. Nerbun
*Attorney, Agent, or Firm*—Richard L. Miller

[57] ABSTRACT

A golf hat having a visor is provided with a pair of blinders for the eyes of the wearer of the hat. The blinders are pivoted to the sides of the visor and locked in place upon the visor by velcro pads when not in use, and pivoted downwardly towards the eyes of the wearer when in use. When in the non-use position, the blinders conform to the contour of the visor so that they are not readily noticeable.

1 Claim, 3 Drawing Figures

GOLF HAT WITH BLINDERS

BACKGROUND OF THE INVENTION

Golf hats are well-known in the art, and typically are made of light fabric and with an airy nature. However, whereas the visor of the hat is meant to help protect against the sun, it is often the case that the visor is not able to adequately protect against the sun, or distractions causing the need for additional protection.

SUMMARY OF THE INVENTION

To this end, the golf hat of the present invention is provided with a pair of blinders that are pivotally connected to the sides of the visor of a conventional golf hat, whereby the blinders are pivotal to a downward position adjacent the eyes of the wearer of the hat in order to protect against the sun, or distractions, and to a non-use position where the blinders are held in place upon the visor itself.

The blinders of the present invention are made of a flexible material and have a triangular shape. Two of the sides of each blinder is curved so that when the two blinders are snapped in place upon the visor by velcro pads, the contour of the inner and outer edges of the blinders will conform to the contour of the inner and outer edges of the visor. In this instance, it is not noticable that the golf hat of the present invention is provided with blinders at all, when these blinders are in the non-use visor-mounted position.

Each of the blinders has a stiffening element to provide structural integrity.

BRIEF DESCRIPTION OF THE DRAWING FIGURES

The invention will be more readily understood with reference to the accompanying drawing, wherein FIG. 1 is a perspective view of the golf hat of the present invention;

FIG. 2 shows a golfer wearing the hat of the present invention with the blinders thereof down in operation; and FIG. 3 is a cross-sectional view taken along line 3—3 of FIG. 1.

DETAILED DESCRIPTION OF THE INVENTION

Figure 2:
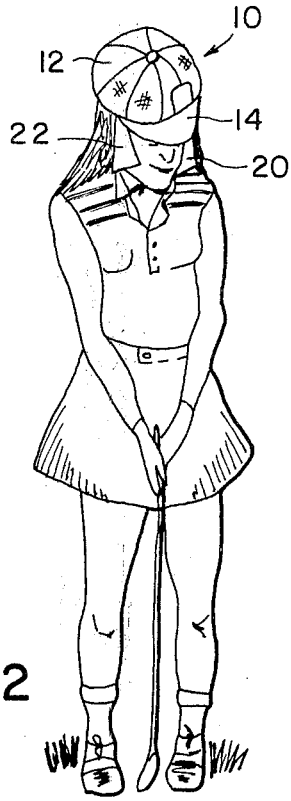

Referring now to the drawing, the golf hat 10 of the present invention is shown. The golf hat 10 has a main portion 12 of conventional design for fitting over the head of the user, as can be seen in FIG. 2. The main portion 12 has connected to its front end a visor 14 having a pair of velcro pads 16, 18 mounted thereon. The visor is of conventional design, and has pivoted thereto at its ends 14' a pair of blinders 20, 22. The blinders 20, 22 pivot relative to the ends 14' of the visor from a position flush with the visor to one that extends downwardly for protection of the eyes of the wearer of the hat, as can be seen in FIG. 2.

The blinders 20, 22 have velcro pads 26, 28 mounted on the inside surface for engagement with the velcro pads 16, 18 respectively, so that the blinders may be held in place upon the visor 14 when not in use. To this end, each of the blinders is in the shape of a right triangle, with curved edges 20', 22' constituting the outer edges, so that when the blinders are not in use, the curvature of the edges 20', 22' will equal the curvature of the visor edge 15.

Each of the blinders is formed with a stiffening element 30, 32 for increasing the structural integrity of the blinders so they will not be easily disarranged, as by a gust of wind.

The inner edges 20", 22" are also curved so as to conform to the inner curved edge 14" of the visor, so that when the blinders are in the closed, non-use position upon the visor, it will not be obvious that blinders are provided at all upon the hat.

Figure 1:
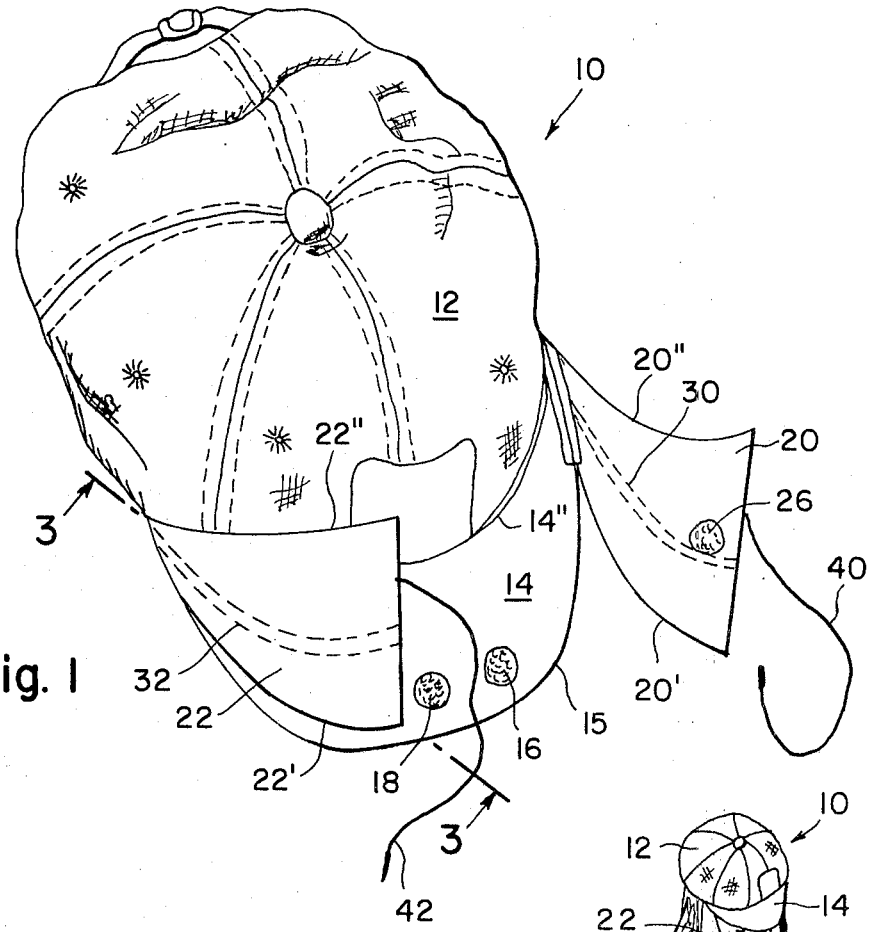
Figure 3:
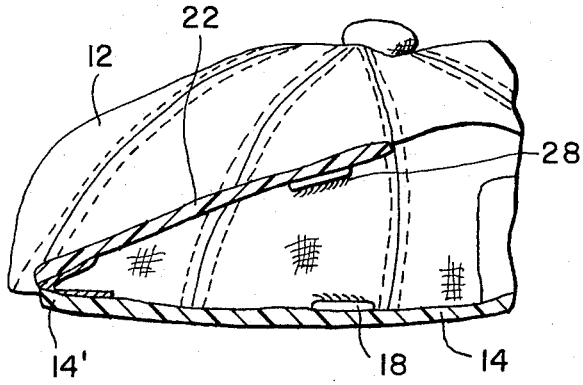

Each of the blinders 20, 22 is provided with a string 40, 42 extending from a side edge which is straight. The strings 40, 42 are used to tie in place the blinders when they are in the downward position, the strings being tied under the chin of the user, as can be seen in FIG. 2. The strings also tie the two blinders together when they are in the non-use visor-mounted position (FIG. 1) to prevent the blinders from falling into the downward position when it is not required to do so.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A golf hat comprising a main portion for covering a head; a visor extending outwardly from the front of said main portion; and a pair of blinders, said pair of blinders being mounted on either side of said visor for extension downwardly of said visor to protect the eyes of the wearer from the sun; said visor having a pair of hook and pile fasteners formed on the top surface thereof for engagement with a pair of hook and pile fasteners on said blinders, each said hook and pile fastener of said blinders being mounted adjacent the front forward edge thereof; each said pair of blinders also having a stiffening element on the inside surface thereof and extending from said front edge surface to the rear of a respective blinder along the entire length of the respective blinder; each said pair of blinders having a right triangular shape, with two edge surfaces perpendicular to each other and a curved front edge surface, said curved front edge surface having a curvature equal to the curvature of the front edge surface of said visor, and the rear edge surface of said blinder also being curved with a curvature equal to the curvature of the rear edge surface of said visor, each said blinder defining a cross-sectional area equal to half the cross-sectional area of said visor, so that when said pair of blinders are mounted upon the top surface of said visor, they conform to the shape thereof; said stiffening element of each said blinder having one of its ends terminating at the intersection of said front curved edge surface and said curved rear edge surface; the edge surface perpendicular to said curved rear edge surface being straight; and each of said pair of blinders having a string extending from said straight edge surface nearer said rear curved edge surface than said front curved edge surface whereby the blinders may be tied under the chin of a wearer when used to shade the sun.

* * * * *